US008855522B2

(12) United States Patent
Ninomiya

(10) Patent No.: US 8,855,522 B2
(45) Date of Patent: Oct. 7, 2014

(54) TONER CONVEYING APPARATUS AND IMAGE FORMING APPARATUS

(75) Inventor: Kenji Ninomiya, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 124 days.

(21) Appl. No.: 13/454,303

(22) Filed: Apr. 24, 2012

(65) Prior Publication Data

US 2012/0294654 A1 Nov. 22, 2012

(30) Foreign Application Priority Data

May 17, 2011 (JP) ..... 2011-110215

(51) Int. Cl.
*G03G 21/10* (2006.01)

(52) U.S. Cl.
CPC ..... *G03G 21/105* (2013.01)
USPC ..... 399/101

(58) Field of Classification Search
CPC ..... G03G 21/105; G03G 2221/1624
USPC ..... 399/101, 120, 358
See application file for complete search history.

(56) References Cited

U.S. PATENT DOCUMENTS 7,415,237 B2 * 8/2008 Okoshi ..... 399/350
2008/0240775 A1 * 10/2008 Mase ..... 399/111

FOREIGN PATENT DOCUMENTS

JP 2000-75614 A 3/2000
JP 2002-311712 A 10/2002
JP 2003-255792 A 9/2003
JP 2005-258300 A 9/2005
JP 2008-83287 A 4/2008

OTHER PUBLICATIONS

Chinese Office Action dated Mar. 24, 2014, in related Chinese Patent Application No. 201210147893.3 (with English translation).

* cited by examiner

*Primary Examiner* — Gregory H Curran
(74) *Attorney, Agent, or Firm* — Fitzpatrick, Cella, Harper & Scinto

(57) ABSTRACT

A toner conveying apparatus includes a conveying unit providing a toner conveyance path having an inlet portion and an outlet portion and provided for conveying toner from the inlet portion to the outlet portion, and a first rotation member that is rotatable and located upstream in a toner conveying direction of the conveyance path, wherein the first rotation member rotates about a first rotating shaft to convey toner from an outside of the toner conveyance path toward the inlet portion. In addition, a second rotation member is rotatable and located downstream in the toner conveying direction of the conveyance path, wherein the second rotation member rotates about a second rotating shaft to convey toner from the outlet portion away from the toner conveyance path, and an agitation device agitates toner in the toner conveyance path. One end portion of the agitation device is connected to a first eccentric shaft eccentric with regard to the first rotation member and another end portion of the agitation device is connected to a second eccentric shaft eccentric with regard to the second rotation member.

20 Claims, 7 Drawing Sheets

TONER CONVEYING APPARATUS AND IMAGE FORMING APPARATUS

BACKGROUND OF THE INVENTION

1. Field of the Invention

The present invention relates to a toner conveying apparatus for conveying toner, and an image forming apparatus having the same.

2. Description of the Related Art

A conventional electrophotographic image forming apparatus has a developing apparatus that uses toner to develop an electrostatic latent image formed on a surface of an image bearing member. The developing apparatus has a conveyance path for conveying toner from a toner storage section to a toner supply section. The conventional electrophotographic image forming apparatus has a toner recovery apparatus that recovers excess toner remaining on the surface of the image bearing member after the toner image of the image bearing member is transferred. The toner recovery mechanism has a conveyance path for conveying toner. The inside of the conveyance path for conveying toner is configured to rotate a screw to convey toner.

Such toner conveying apparatuses each having a conveyance path for conveying toner are disclosed in Japanese Patent Application Laid-Open No. 2002-311712 and Japanese Patent Application Laid-Open No. 2005-258300. The toner conveying apparatuses disclosed in Japanese Patent Application Laid-Open No. 2002-311712 and Japanese Patent Application Laid-Open No. 2005-258300 are the invention relating to a toner conveying apparatus including a conveyance path for conveying toner; a rotatable rotating shaft located in one end portion of the conveyance path; and an agitation member eccentrically connected to the rotating shaft to agitate toner inside the conveyance path. Such a configuration can efficiently convey tone without aggregation or adhering of toner.

Unfortunately, according to the toner conveying apparatuses disclosed in Japanese Patent Application Laid-Open No. 2002-311712 and Japanese Patent Application Laid-Open No. 2005-258300, one end portion of the agitation member is eccentrically connected to the rotating shaft, but the other end portion of the agitation member is free, whereby the swing area of swinging the agitation member inside the conveyance path is limited.

FIG. 7 is an enlarged sectional view that explanatorily shows a feature of a swing area in which an agitation member can swing is restricted. As illustrated in FIG. 7, a toner conveying apparatus 525 is configured such that one end of an agitation shaft 60 (agitation member) eccentrically connected to a crank and the other end of the agitation shaft 60 is free. An upstream screw shaft 28*a* that is an end of an upstream screw shaft rotates a crankshaft 29 to swing the agitation shaft 60.

Thus, the agitation shaft 60 swings in a transverse direction (indicated by an arrow P) and in a longitudinal direction (indicated by an arrow Q) to prompt to convey toner on the bottom side of a conveyance case 27, but cannot cover the entire area inside the conveyance case 27 including toner on the ceiling surface side thereof as the agitation shaft movable area. As a result, a non-agitation area 59 (area enclosed by the one-dot chain line) remains.

Further, the agitation shaft 60 on a downstream end side performs only translational motion as indicated by an arrow Q, which generates a non-agitation area 59, which presses toner to move outside a movable area to adhere thereto, which may prompt, toner clogging.

SUMMARY OF THE INVENTION

A purpose of the present invention is to provide a toner conveying apparatus capable of preventing a toner conveyance failure more than ever such that toner is retained by depositing and adhering inside a conveyance path.

Another purpose of the present invention is to provide a toner conveying apparatus including a toner conveyance path having an inlet portion and an outlet portion and provided for conveying toner from the inlet portion to the outlet portion; a rotatable first rotation member located upstream in a toner conveying direction of the conveyance path; a rotatable second rotation member located downstream in the toner conveying direction of the conveyance path; and an agitation device having and being connected to a connecting shaft eccentrically connected to each rotating shaft of the first rotation member and the second rotation member to agitate toner inside the conveyance path.

A further purpose of the present invention is to provide an image forming apparatus including an image forming section for forming an image by toner, a toner conveyance path having an inlet portion and an outlet portion and provided for conveying toner from the inlet portion to the outlet portion, a rotatable first rotation member located upstream in a toner conveying direction of the conveyance path, a rotatable second rotation member located downstream in the toner conveying direction of the conveyance path, and an agitation device eccentrically connected to each rotating shaft of the first rotation member and the second rotation member to agitate toner inside the conveyance path.

A still further purpose of the present invention will become apparent from the following description of exemplary embodiments with reference to the accompany drawings.

DESCRIPTION OF THE EMBODIMENTS

Preferred embodiments of the present invention will now be described in detail in accordance with the accompanying drawings.

Now, exemplary embodiments of the present invention will be illustratively described in detail with reference to the accompanying drawings. It should be noted that the sizes, the materials, the shapes, and their relative positions of the respective components described in the embodiments should be modified as needed depending on the configuration of the apparatus and other various conditions to which the present invention is applied and thus, unless otherwise specifically indicated, the scope of the present invention should not be construed to be limited to the embodiments.

First Embodiment

Figure 1:
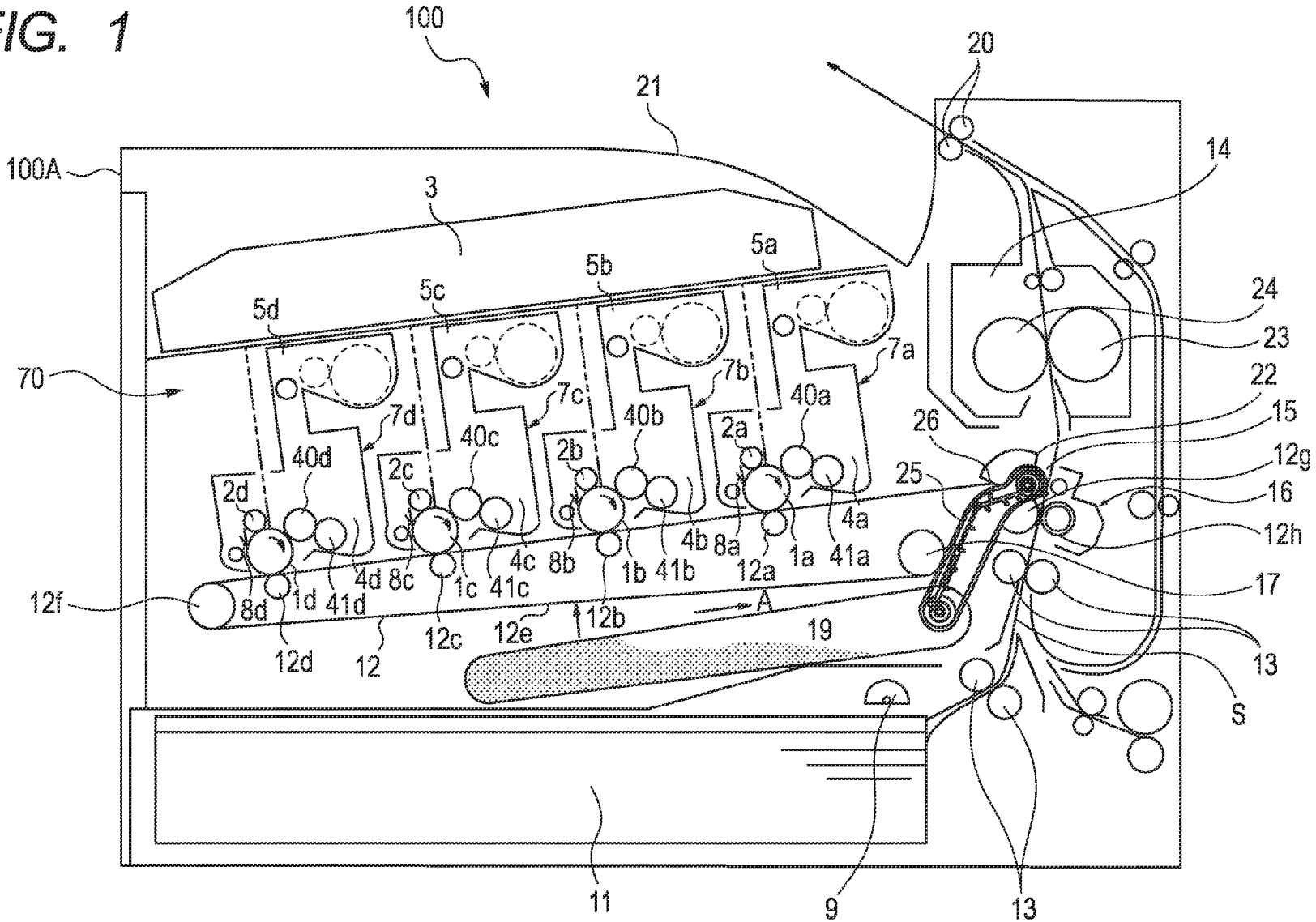
FIG. 1 is a sectional view illustrating a configuration of an image forming apparatus according to a first embodiment of the present invention.

FIG. 1 is a sectional view illustrating a configuration of an image forming apparatus 100 according to a first embodiment of the present invention. The image forming apparatus 100 is an image forming apparatus having a duplex printing function using an electrophotographic image forming process. As illustrated in FIG. 1, the image forming apparatus 100 has an image forming apparatus body (hereinafter referred to simply as an apparatus body) 100A. The apparatus body 100A includes thereinside an image forming section 70 for forming an image. The image forming section 70 includes a photosensitive drum 1 as an image bearing member, transfer rollers 12*a* to 12*d* as a transfer apparatus, and the like.

The image forming apparatus 100 includes four electrophotographic photosensitive drums (each referred to individually as a "photosensitive drum 1*a*, 1*b*, 1*c*, or 1*d*" and collectively referred to as a "photosensitive drum 1") arranged in parallel in an oblique direction each serving as an image bearing member. The photosensitive drum 1 is an image bearing member that bears a toner image such that the photosensitive drum 1*a* bears yellow toner; the photosensitive drum 1*b* bears magenta toner; the photosensitive drum 1*c* bears cyan toner; and the photosensitive drum 1*d* bears black toner.

Each photosensitive drum 1 includes therearound a "charging device", a "developing device", and a "cleaning device" in this order starting from the upstream side in the rotational direction thereof. The "charging device" corresponds to primary charging devices 2*a*, 2*b*, 2*c*, and 2*d* (hereinafter referred to simply as a "primary charging device 2"). The "developing device" corresponds to developing devices 40*a*, 40*b*, 40*c*, and 40*d* (hereinafter referred to simply as a "developing device 40"). The "cleaning device" corresponds to cleaning blades 8*a*, 8*b*, 8*c*, and 8*d* (hereinafter referred to simply as a "cleaning device 8").

The primary charging device 2 uniformly charges the surface of the photosensitive drum 1. The surface of the photosensitive drum 1 uniformly charged by the primary charging device 2 based on image information is irradiated with a laser beam by an exposing device 3 to form an electrostatic latent image. The developing device 40 deposits each color toner on the surface of the photosensitive drum 1 having a formed electrostatic latent image to visualize the electrostatic latent image as a toner image. The cleaning device 8 removes toner remaining on the surface of the photosensitive drum 1 after transfer.

The position facing the photosensitive drum 1 includes an intermediate transfer belt 12*e* as an intermediate transfer member subjected to a primary transfer of the toner image formed on the surface of the photosensitive drum 1. The intermediate transfer belt 12*e* is supported by a drive roller 12*g*, a tension roller 12*f*, and a driven roller 12*h*.

Each toner image formed on the photosensitive drum 1 is primarily transferred to the intermediate transfer belt 12*e* by the action of transfer rollers 12*a*, 12*b*, 12*c*, and 12*d* each serving as a "transfer device". The position facing the drive roller 12*g* includes a driven roller 12*h* as a secondary transfer device 16 sandwiching the intermediate transfer belt 12*e* therebetween.

Transfer materials S are separated one by one to be fed from a feed cassette 11 by a pickup roller 9 as a separation conveying unit. Then, the transfer materials S are conveyed to a registration roller pair 17 by a conveying roller pair 13 and further conveyed to between the intermediate transfer belt 12*e* and the secondary transfer device 16 at a predetermined timing by the registration roller pair 17. Finally, by the action of the secondary transfer device 16, the toner image primarily transferred to the intermediate transfer belt 12*e* is secondarily transferred to the transfer material S.

The transfer material S having the transferred toner image is conveyed to a fixing device 14 having a heat roller 24 and a pressure roller 23, in which the toner image is fixed to the transfer material S. Then, the transfer material S is conveyed by a discharge roller pair to be discharged onto a discharge tray 21 located an upper portion of the apparatus body 100A.

Meanwhile, after the toner image is transferred, toner remaining on each surface of the photosensitive drums 1*a*, 1*b*, 1*c*, and 1*d* is removed by the respective cleaning blades 8*a*, 8*b*, 8*c*, and 8*d*. Further, after the toner is secondarily transferred to the transfer material S, the toner remaining on the intermediate transfer belt 12 is removed by a transfer belt cleaning device 22. The removed toner is passed through a waste toner conveying unit 25 and is recovered by a waste toner recovery container 19. The transfer belt cleaning device 22 has a cleaning blade unit 26.

Figure 2:
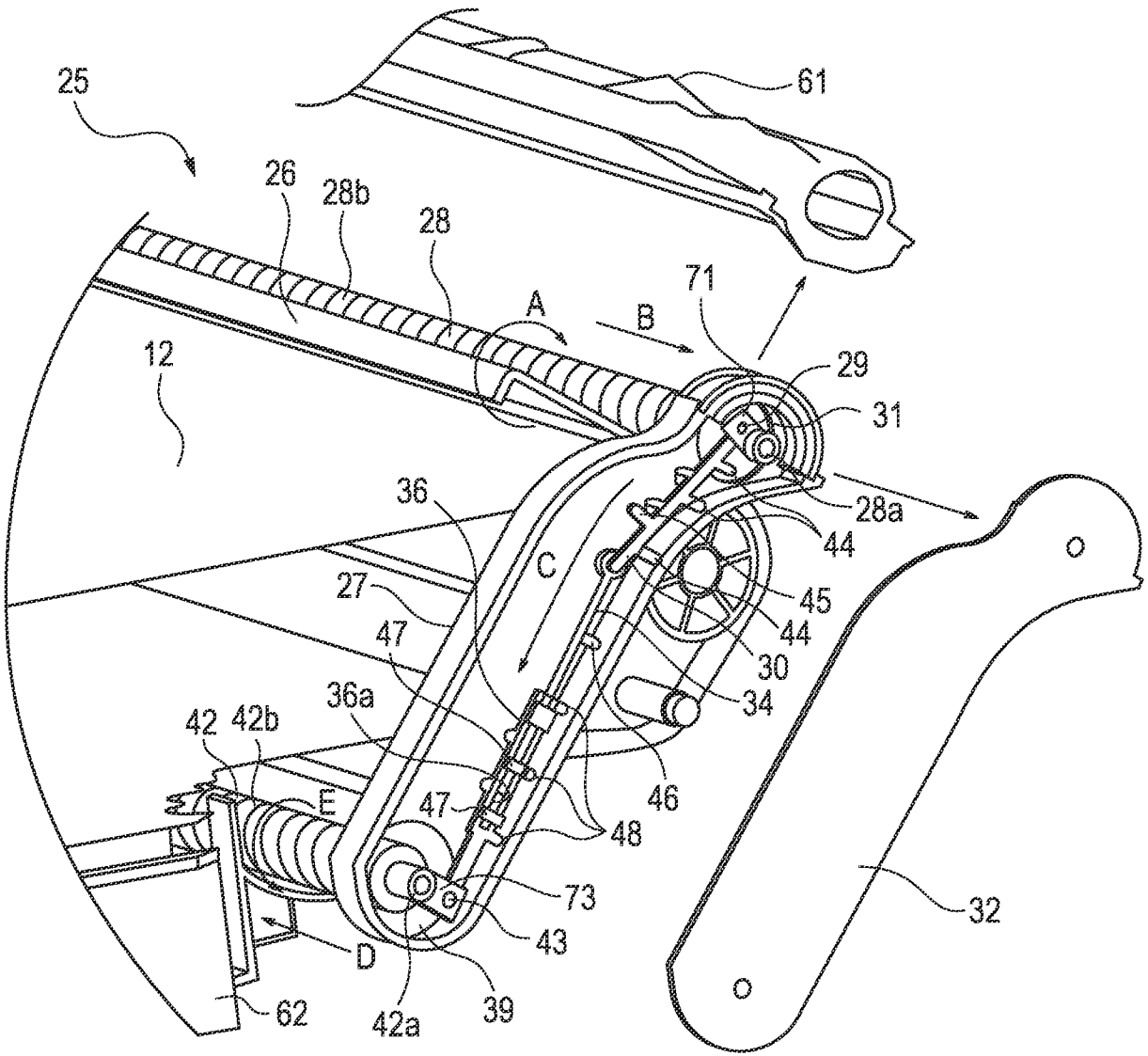
FIG. 2 is an exploded perspective view illustrating a configuration of a waste toner conveying unit.

FIG. 2 is an exploded perspective view illustrating a configuration of the waste toner conveying unit 25. The waste toner conveying unit 25 as a toner conveying unit includes a conveyance case 27 as a conveyance path for conveying toner from an upstream side to a downstream side in a conveying direction; an upper cover 61; and a conveying cover 32. In comparison with the state of FIG. 1, FIG. 2 illustrates the internally visible state of the conveyance case 27 by detaching the conveying cover 32 and the upper cover 61 from the conveyance case 27. The conveying cover 32 is bonded to the conveyance case 27 to form the toner conveyance path and rotatably hold a crankshaft 29 (described later) located near an inlet hole 31 of the conveyance case 27 and a crankshaft 43 (described later) located near an outlet hole 39 of the conveyance case 27. Here, the inlet hole 31 serves as an inlet portion through which the toner conveyed by an upstream screw shaft 28*a* enters the conveyance path; and the outlet hole 39 serves as an outlet portion through which toner is conveyed from inside the conveyance path to outside by a downstream screw shaft 42 (described later).

The waste toner conveying unit 25 includes an upstream screw shaft 28, a crankshaft 29, and an upstream agitation member 30 on an upstream side in a toner conveying direction of the conveyance case 27. The upstream agitation member 30 constitutes an agitation device.

The upstream screw shaft 28 includes a screw shaft 28*a* as a first rotating shaft; and a plurality of fins 28*b* (conveying member) provided in the screw shaft 28*a*. The upstream screw shaft 28 as the first rotation member is a rotatable shaft located on an upstream side of the conveyance case 27. The upstream screw shaft 28 sequentially conveys the waste toner removed from the surface of the intermediate transfer belt 12*e* by the cleaning blade unit 26 in a direction indicated by an arrow B while rotating the toner in a direction indicated by an arrow A into the conveyance case 27. The screw shaft 28*a* of the upstream screw shaft 28 has a jointed portion 71. The jointed portion 71 has the crankshaft 29.

The crankshaft 29 as a first eccentric shaft is located at an end portion of the upstream screw shaft 28, namely, a position eccentric to the screw shaft 28*a* serving as a rotational center of the upstream screw shaft 28 to convert rotary motion to crank motion. The crankshaft 29 has the upstream agitation member 30.

The upstream agitation member 30 as a first agitation member has one end portion 30*x* (see FIGS. 3A and 3B) connected to the crankshaft 29 to agitate toner inside the conveyance case 27. The upstream agitation member 30 is rotatably connected to the crankshaft 29. When the crank motion is transmitted, the waste toner conveyed through the inlet hole 31 of the conveyance case 27 by the upstream screw shaft 28 is fed to the downstream side.

Figure 3A:
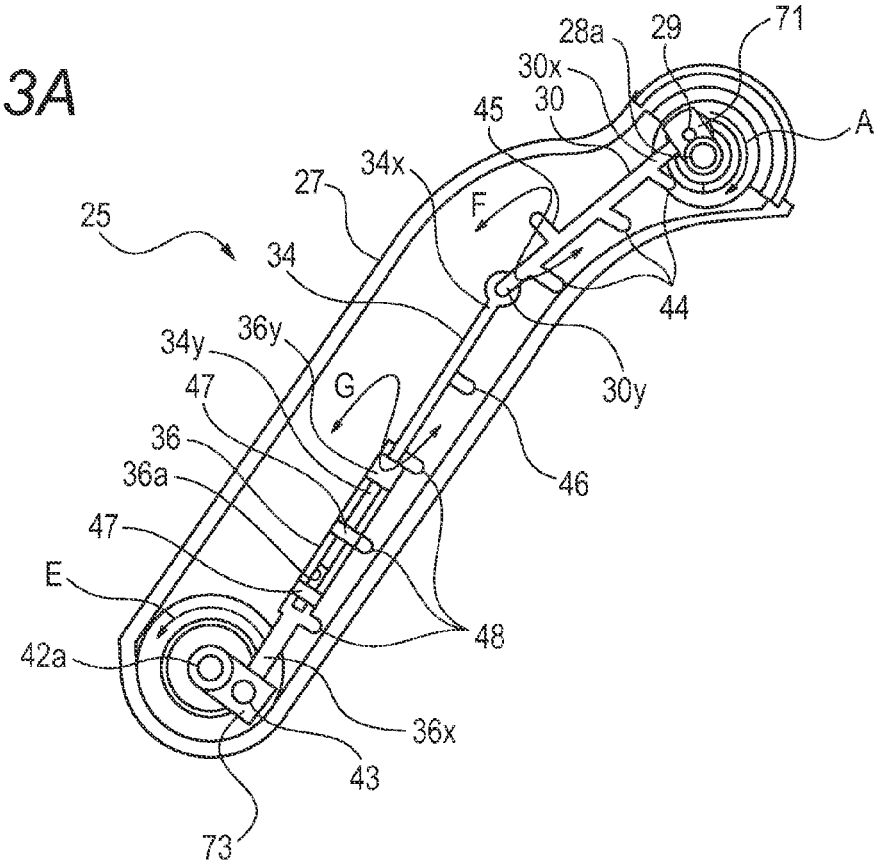
FIGS. 3A and 3B are sectional views illustrating a configuration of the waste toner conveying unit.
Figure 3B:
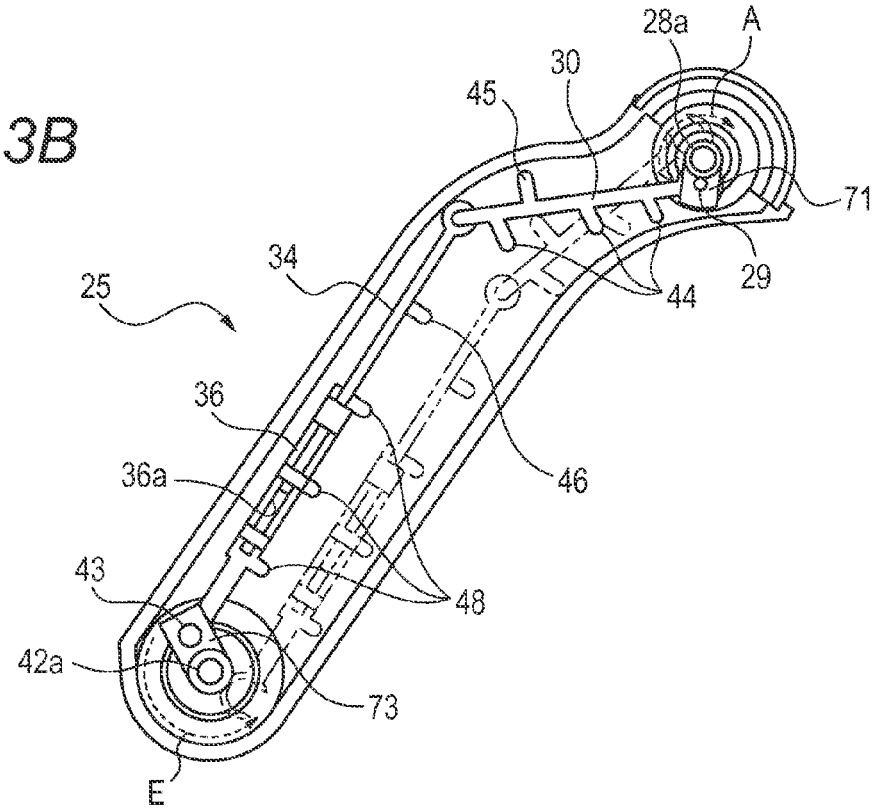

The upstream agitation member 30 includes a plurality of protruding portions 44 (downward projecting portions) each projecting downward; and a protruding portion 45 (upward projecting portion) projecting upward. Note that FIGS. 3A and 3B illustrate only one protruding portion 45, but a plurality of protruding portions 45 may be provided. The protruding portion 44 agitates toner while sliding along the bottom surface of the conveyance case 27. The protruding portion 45 agitates toner while repeatedly moving close to and far away from the top surface of the conveyance case 27.

The waste toner conveying unit 25 has a downstream screw shaft 42 located on a downstream side in a toner conveying direction of the conveyance case 27.

The downstream screw shaft 42 has a screw shaft 42*a* as a second rotating shaft; and a plurality of fins 42*b* provided in the screw shaft 42*a*. The downstream screw shaft 42 as the second rotating shaft is a rotatable shaft located on a downstream side of the conveyance case 27. The downstream screw shaft 42 sequentially conveys the waste toner conveyed inside the conveyance case 27 in a direction indicated by an arrow D while rotating the toner in a direction indicated by an arrow E to be discharged through the outlet hole 39 into a waste toner case 62. The screw shaft 42*a* of the downstream screw shaft 42 has a jointed portion 73. The jointed portion 73 has a crankshaft 43.

The crankshaft 43 as a second eccentric shaft is located at an end portion of the downstream screw shaft 42, namely, a position eccentric to the screw shaft 42*a* serving as a rotational center of the downstream screw shaft 42 to convert rotary motion to crank motion. The crankshaft 43 has a downstream agitation member 36. The downstream agitation member 36 constitutes the agitation member 36.

The downstream agitation member 36 as a second agitation member has one end portion 36*x* (see FIGS. 3A and 3B) connected to the crankshaft 43 to agitate toner inside the conveyance case 27. The downstream agitation member 36 is rotatably connected to the crankshaft 43. When the crank motion is transmitted, the downstream agitation member 36 prompts to convey the waste toner inside the conveyance case 27 out through the outlet hole 39.

The downstream agitation member 36 includes a plurality of protruding portions 48 (downward projecting portions) each projecting downward; and a protruding portion 47 (sideward projecting portion) projecting sideward. The protruding portion 48 agitates toner while sliding along the bottom surface of the conveyance case 27. The plurality of protruding portions 47 conveys toner falling downward while agitation the toner in a conveying direction.

The waste toner conveying unit 25 has a slide member 34. The slide member 34 is provided between the other end portion 30*y* of the upstream agitation member 30 (see FIGS. 3A and 3B) and the other end portion 36*y* of the downstream agitation member 36 (see FIGS. 3A and 3B). An upstream portion 34*x* (see FIGS. 3A and 3B) as a first end portion of the slide member 34 is rotatably attached to the other end portion 30*y* of the upstream agitation member 30. A downstream portion 34*y* (see FIGS. 3A and 3B) as a second end portion of the slide member 34 is slidably inserted into and attached to a groove portion 36*a* formed in the other end portion 36*y* of the downstream agitation member 36. As thus configured, the upstream agitation member 30, the downstream agitation member 36, and the slide member 34 are bendably configured as a whole.

The slide member 34 provided between the upstream agitation member 30 and the downstream agitation member 36 expands and contracts depending on the interval variability occurring during the crank motion of the upstream agitation member 30 and the crank motion of the downstream agitation member 36, thereby enabling the connection between the upstream agitation member 30 and the downstream agitation member 36.

FIG. 3A is a sectional view illustrating a configuration of the waste toner conveying unit 25. The upstream screw shaft 28 is connected to the downstream screw shaft 42 through the crankshafts 29 and 43. The upstream agitation member 30, the slide member 34, and the downstream agitation member 36 have the protruding portions 44 to 48 for agitating toner inside the conveyance case 27.

While the upstream screw shaft 28 rotates in the direction indicated by the arrow A, the downstream screw shaft 42 accordingly rotates in the direction indicated by the arrow E. Thus, the upstream agitation member 30 and the downstream agitation member 36 connecting the screw shafts therebetween can move not in a translational direction simply by swinging but in directions as indicated by the arrows F and G.

FIG. 3B is a sectional view illustrating each operational area of the upstream agitation member 30 and the downstream agitation member 36 inside the conveyance case 27. In FIG. 3B, the solid line portion indicates the state in which the upstream agitation member 30 and the downstream agitation member 36 swing upward inside the conveyance case 27; and the two-dot chain line portion indicates the state in which the upstream agitation member 30 and the downstream agitation member 36 swing downward inside the conveyance case 27.

The upstream agitation member 30 and the downstream agitation member 36 moves substantially entirely inside the conveyance case 27, and the protruding portions 44 to 48 knock off not only the toner remaining on the bottom surface of the conveyance case 27 but also the toner adhering to the wall thereof, whereby the non-agitation area can be reduced without deposition space. As a result, toner clogging due to deposition or adhering of toner can be prevented.

In the conveyance case 27, the inlet hole 31 is located at a position higher than the outlet hole 39 with respect to the toner conveying direction so as to convey toner from top to bottom using the weight of toner. Thus, the toner falls or slides along the slope of the bottom surface of the conveyance case 27 by its own weight and further can be conveyed from upstream to downstream by the action of protruding portions 44 to 48 of the upstream agitation member 30 and the downstream agitation member 36. At this time, the agitating action of the protruding portions 44 to 48 of the upstream agitation member 30 and the downstream agitation member 36 reduces the amount of residual waste toner, which has an effect of preventing toner clogging inside the conveyance case 27.

Examples of the material of the protruding portions 44 to 48 include an elastic material such as a rubber material and a low-hardness resin material. Here, contacting the protruding portions 44 to 48 to the inner wall of the conveyance case 27 improves the agitating action by removing or scraping the toner adhering to the wall surface. Further, the elastic force has an effect of reducing the contact sound to the bottom surface.

Figure 4:
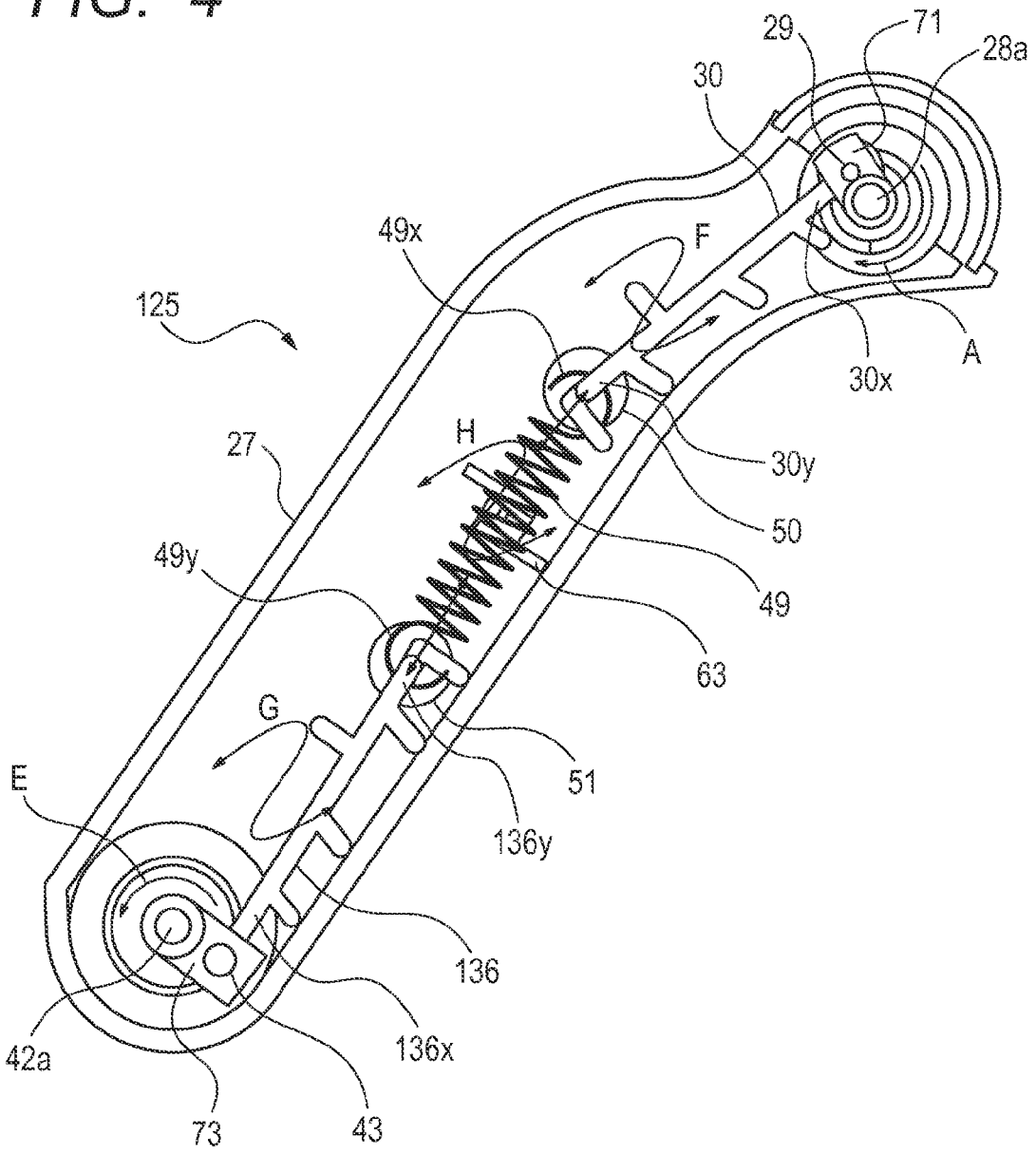
FIG. 4 is a sectional view illustrating a configuration of a waste toner unit according to a variation of the first embodiment.

FIG. 4 is a sectional view illustrating a configuration of a waste toner unit 125 according to a variation of the first embodiment. The waste toner unit 125 as a toner conveying apparatus has a spring 49 as an elastic member such as a spring provided between an upstream agitation member 30 and a downstream agitation member 136 instead of the slide member 34 illustrated in FIGS. 3A and 3B. Here, the spring 49 as the elastic member such as a spring provided between the upstream agitation member 30 and the downstream agitation member 136 is a agitation device. More specifically, the spring 49 as an extension and contraction member is an extensible and contractible member such that an upstream side end portion 49*x* as a first end portion is attached to the other end portion 30*y* of the upstream agitation member 30; and a downstream side end portion 49*y* as a second end portion is attached to the other end portion 136*y* of the downstream agitation member 136. The spring 49 expands and contracts with the actions of the upstream agitation member 30 and the downstream agitation member 136. Here, one end portion 136*x* of the downstream agitation member 136 is connected to the crankshaft 43.

The spring 49 is hooked on each end portion of the upstream agitation member 30 and the downstream agitation member 136 to transmit the pulling force of the spring. The pushing force of the spring 49 at compression is transmitted to the upstream agitation member 30 and the downstream agitation member 136 by flanges 50 and 51 respectively. The waste toner unit 125 includes agitation parts 63 having a protrusion for agitating toner in a center portion of the spring 49.

When the upstream crankshaft 29 and the downstream crankshaft 43 are rotated, the upstream agitation member 30, the downstream agitation member 136, and the agitation parts 63 move as indicated by arrows F, G, and H. Then, the protruding portions 44 to 48 each extending therefrom agitates toner substantially entirely inside the conveyance case 27 and can prompt to convey the toner. As a result, toner clogging in the conveyance case 27 constituting the toner conveyance path can be prevented.

Second Embodiment

FIGS. 5A to 5D each are a sectional view illustrating a configuration of a waste toner conveying unit 225 according to a second embodiment. Of the components of the waste toner conveying unit 225 according to the second embodiment, the same components and effects as those of the waste toner conveying unit 25 of the first embodiment are assigned with the same reference numerals or characters and the detailed descriptions will be omitted as needed. The second embodiment can be applied to the same image forming apparatus as described in the first embodiment and thus the description of the image forming apparatus is omitted. The waste toner conveying unit 225 of the second embodiment is different from the waste toner conveying unit 25 of the first embodiment in that the waste toner conveying unit 225 is configured such that the toner conveyance path is substantially horizontal. FIGS. 5A to 5D each are a process view describing the toner conveying operation.

The waste toner conveying unit 225 as the toner conveying apparatus has a conveyance case 55 for forming the toner conveyance path. The waste toner conveying unit 225 has an upstream screw shaft 28 on an upstream side in the toner conveying direction. The upstream screw shaft 28 is rotated by an unillustrated driving source to feed toner into the conveyance case 55. The waste toner conveying unit 225 has a downstream screw shaft 42 on a downstream side in the toner conveying direction. The downstream screw shaft 42 is rotated by an unillustrated driving source to discharge toner from the conveyance case 55.

The crankshaft 29 as a first eccentric shaft is eccentrically attached to a screw shaft 28*a* (unillustrated) of the upstream screw shaft 28 as a first rotation member. Specifically, an end portion of the upstream screw shaft 28 includes the crankshaft 29 with the shaft located at a position (position eccentric from the screw shaft 28*a*) different from the rotational center. The crankshaft 43 as a second eccentric shaft is eccentrically attached to a screw shaft 42*a* (unillustrated) of the downstream screw shaft 42 as a second rotation member. Specifically, an end portion of the downstream screw shaft 42 includes the crankshaft 43 with the shaft located at a position (position eccentric from the screw shaft 42*a*) different from the rotational center.

Each end portion of the agitation member 56 has elongated hole portions 51 and 53. More specifically, one end portion 56*x* of the agitation member 56 as the agitation device has the elongated hole portion 51 as a first elongated hole portion; and the other end portion 56*y* thereof has the elongated hole portion 53 as a second elongated hole portion. A crankshaft 29 is slidably inserted into the elongated hole portion 51. The crankshaft 29 can move inside the elongated hole portion 51. A crankshaft 43 is slidably inserted into the elongated hole portion 53. The crankshaft 43 can move inside the elongated hole portion 53.

The agitation member 56 is eccentrically connected to a screw shaft 28*a* and a screw shaft 42*a* to agitate toner inside the conveyance case 27. The agitation member 56 has a trunk portion connecting the two elongated hole portions 51 and 53 and the trunk portion has lower protruding portions 52 and upper protruding portions 54 thereon.

Figure 5A:
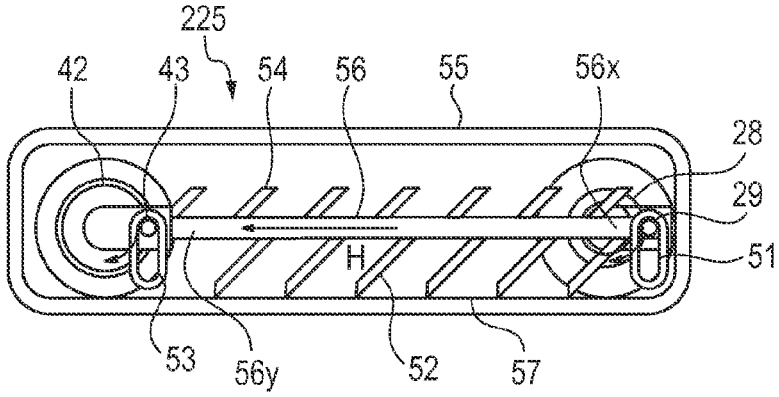
FIGS. 5A, 5B, 5C, and 5D are sectional views illustrating a configuration of a waste toner conveying unit according to a second embodiment.
Figure 5B:
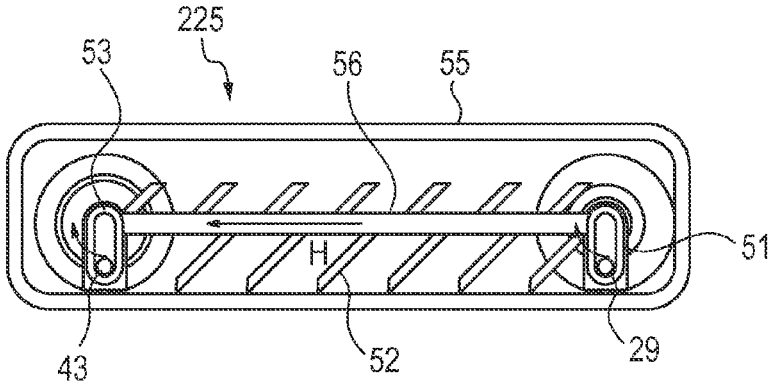
Figure 5C:
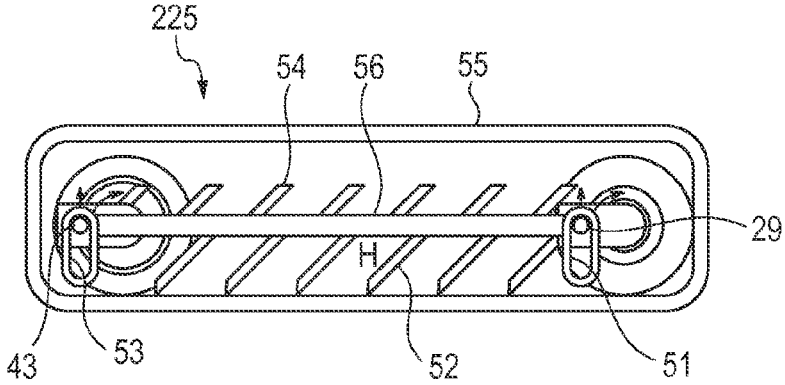
Figure 5D:
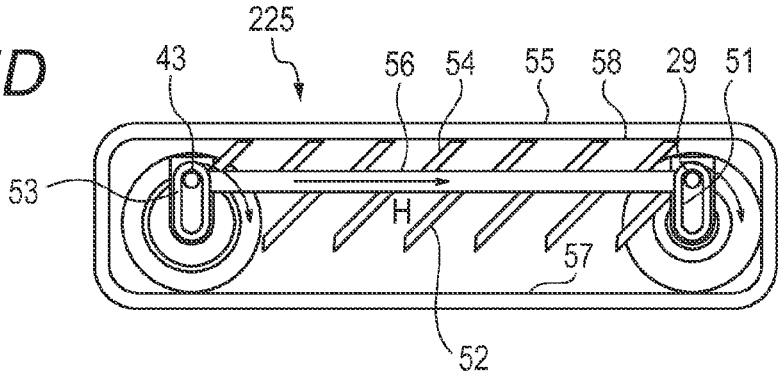

FIGS. 5B, 5C, and 5D each illustrate a state in which rotation of the upstream screw shaft 28 and the downstream screw shaft 42 sequentially rotates the connected crankshafts 29 and 43 by 90 degrees from the state of FIG. 5A. The crankshafts 29 and 43 rotate in a direction (clockwise direction) indicated by arrows in the same rotation period.

In FIGS. 5A and 5B, the crankshafts 29 and 43 at each end of the agitation member 56 slide while pressing downward against the inside of the elongated hole portions 51 and 53 of the agitation member 56 by the rotation of the screw shafts 28*a* and 42*a* in a clockwise direction to move the agitation member 56 to the left side. At this time, the agitation member 56 slides while the lower tips of the plurality of lower protruding portions 52 are in press-contact with a bottom surface 57 of the conveyance case 55 by their own weight. Thereby, the agitation member 56 conveys toner inside the conveyance case 55 from right to left.

In FIGS. 5C and 5D, the crankshafts 29 and 43 slide in the same manner as described above while lifting upward against the inside of the elongated hole portions 51 and 53 of the agitation member 56 by the rotation of the screw shafts in the clockwise direction to move the agitation member 56 to the right side. The plurality of lower protruding portions 52 of the agitation member 56 is lifted from the bottom surface 57 to move rightward. Thus, the toner on the bottom surface 57 of the conveyance case 55 can be moved rightward without backflow. Then, the crankshafts return to the positions illustrated in FIG. 5A.

The operations from FIGS. 5A to 5D and then back to FIG. 5A enable repeated conveyance of toner on the bottom surface 57 from right to left. In a position of FIG. 5D, the plurality of upper protruding portions 54 can knock off the toner adhering to the top surface inside the conveyance case 55, which has an effect of preventing toner clogging inside the conveyance case 55.

Figure 6A:
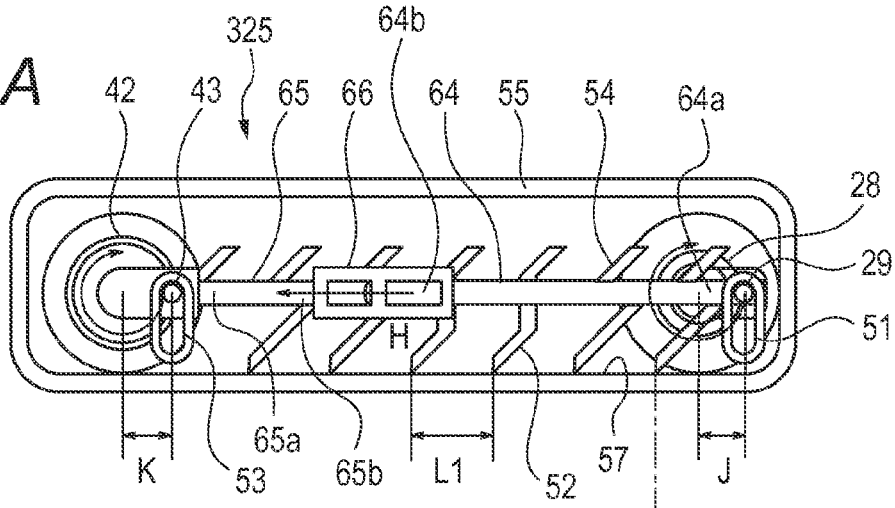
FIGS. 6A, 6B, and 6C each are a sectional view illustrating a configuration of a waste toner conveying unit according to a variation of the second embodiment.
Figure 6B:
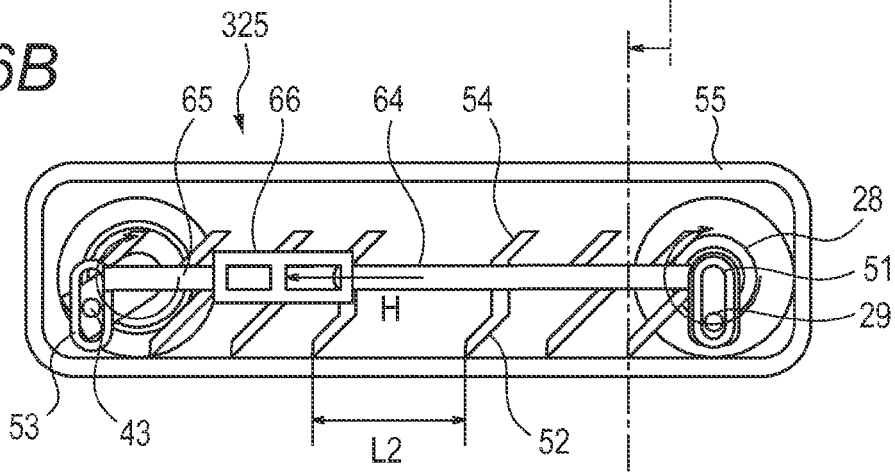
Figure 6C:
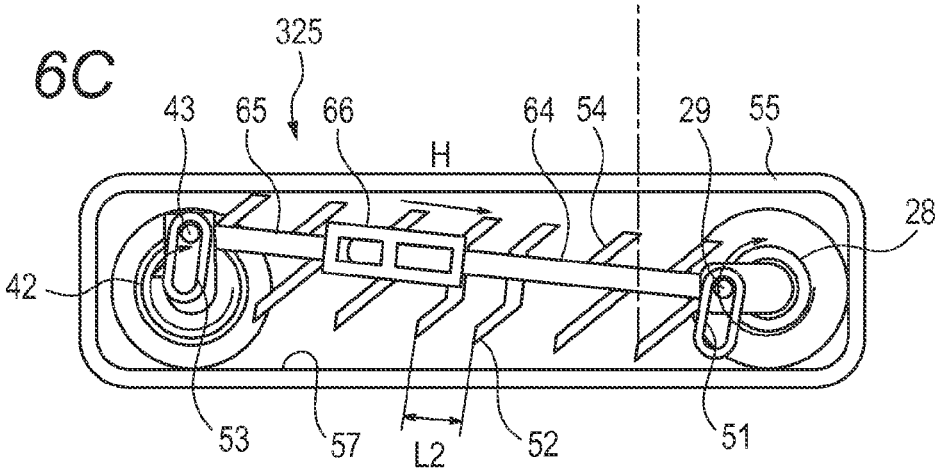
Figure 7:
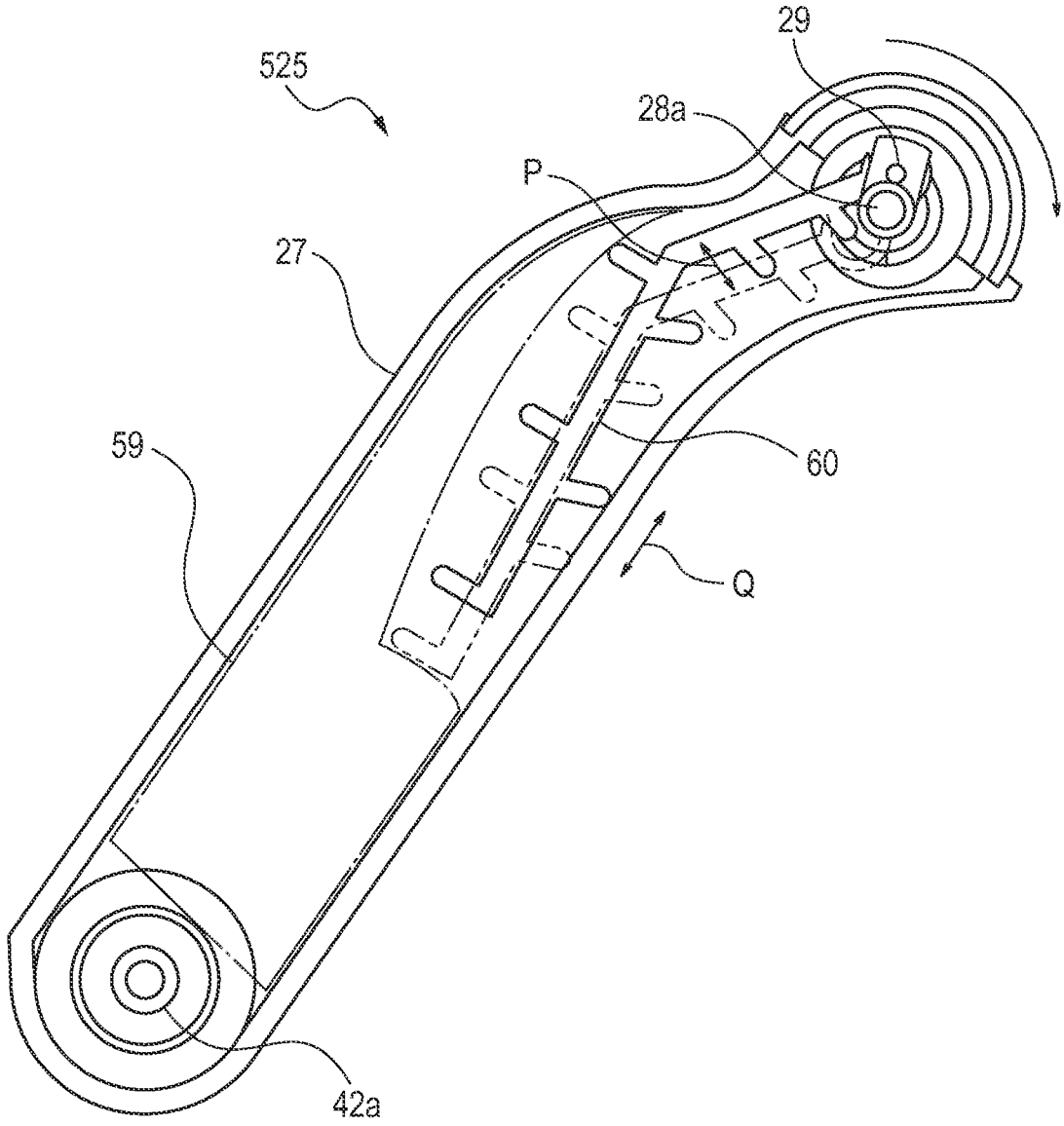
FIG. 7 is an enlarged sectional view illustrating a configuration of a toner conveying apparatus according to a conventional example.

FIGS. 6A to 6C each are a sectional view illustrating a configuration of a waste toner conveying unit 325 according to a variation of the second embodiment. With reference to FIGS. 6A to 6C, the description will focus on the movement in a case in which the turning radius J of the crankshaft 29 has a rotation period different from that of the turning radius K of the crankshaft 43.

The waste toner conveying unit 325 as the toner conveying apparatus has an agitation shaft configured such that an upstream agitation member 64 located on an upstream side in a toner conveying direction is slidably connected to a downstream agitation member 65 located on a downstream side in the toner conveying direction at a slide rail portion 66.

Specifically, the upstream agitation member 64 as the first agitation member has one end portion 64*a* connected to the crankshaft 29 eccentric to a screw shaft 28*a* (unillustrated) of the upstream screw shaft 28 to agitate toner inside the conveyance case 27. The one end portion 64*a* of the upstream agitation member 64 has an elongated hole portion 51 as the first elongated hole portion. The crankshaft 29 is slidably inserted into the elongated hole portion 51.

The downstream agitation member 65 as the second agitation member has one end portion 65*a* connected to the crankshaft 43 eccentric to a screw shaft 42*a* (unillustrated) of the downstream screw shaft 42 to agitate toner inside the conveyance case 27. The one end portion 65*a* of the downstream agitation member 65 has an elongated hole portion 53 as the second elongated hole portion. The crankshaft 43 is slidably inserted into the elongated hole portion 53.

The slide rail portion 66 as a connection portion is located at the other end portion 65*b* of the downstream agitation member 65. The slide rail portion 66 slidably accepts and retains the other end portion 64*b* of the upstream agitation member 64. Note that this configuration may be reversed. More specifically, the slide rail portion 66 may be located at the other end portion 64*b* of the upstream agitation member 64. In this case, the slide rail portion 66 slidably accepts and retains the other end portion 65*b* of the downstream agitation member 65.

The upstream agitation member 64 and the downstream agitation member 65 have a plurality of lower protruding portions 52 and upper protruding portions 54 respectively as described in FIGS. 5A to 5D. The turning radius J of the crankshaft 29 has a rotation period different from that of the turning radius K of the downstream crankshaft.

In the state of FIG. 6A, the inter-shaft distance between the upstream agitation member 64 and the downstream agitation member 65 is L1, but in the state of FIG. 6B in which two crankshafts 29 and 43 rotate, the inter-shaft distance is L2. The downstream agitation member 65 and the upstream agitation member 64 move in a direction indicated by an arrow H while the upstream agitation member 64 slides inside the slide rail portion 66 of the downstream agitation member 65, whereby a difference in moving amount between the two agitation members can be adjusted. Thus, the toner inside the conveyance case 55 is conveyed from right to left.

FIG. 6C illustrates a state in which two crankshafts 29 and 43 further rotate in a state of FIG. 6B. When the crankshaft 29 rotates, the upstream agitation member 64 moves from right to left to convey toner. Meanwhile, when the crankshaft 43 on the downstream side rotates, the crankshaft 43 on the downstream side moves inside the elongated hole portion 53 of the downstream agitation member 65 and moves from left to right while lifting the downstream agitation member 65. Thereby, the lower protruding portion 52 of the downstream agitation member 65 can be separated from the bottom surface of the conveyance case 55 to move from left to right, whereby the toner can be conveyed right to left without backflow.

When the crankshaft 29 further rotates in a state of FIG. 6C, the upstream agitation member 64 moves from left to right in the same manner as the downstream agitation member 65 is lifted, the upstream agitation member 64 can be moved rightward without backflow of the toner on the bottom surface 57 of the conveyance case 55. While moving from left to right, the plurality of upper protruding portions 54 protruding upward knocks off the toner adhering to the top surface of the conveyance case 55.

As thus operated, when two agitation members slide and move from left to right, the toner adhering to the top surface of the conveyance case 55 is knocked off toward the bottom surface 57 of the conveyance case 55 and the toner on the bottom surface 57 is conveyed from right to left, which operation is repeated. Thus, toner can be conveyed inside the conveyance case 55 by preventing toner clogging.

In the first and second embodiments, the description has been made by taking an example of the waste toner conveyance path through which the waste toner removed by a transfer belt cleaning apparatus 22 is conveyed by the upstream screw shaft 28 and the downstream screw shaft 42, but the present invention is not limited to this configuration. For example, the present invention can be applied to a toner conveyance path connecting a toner supply container unit, a developing container unit, a drum cleaning unit, and a waste toner container unit for use in the electrophotographic process.

According to the configuration of the first and second embodiments, and the variations thereof, the upstream agitation member 30 and the downstream agitation member 36 (the agitation member 56) and (the upstream agitation member 64 and the downstream agitation member 65) are eccentrically connected to the screw shaft 28*a* and the screw shaft 42*a* respectively at each end of the conveyance case 27. This configuration improves the sliding efficiency of the upstream agitation member 30 and the downstream agitation member 36 (the agitation member 56) and (the upstream agitation member 64 and the downstream agitation member 65) sliding inside the conveyance case 27 over the entire area of the conveyance case 27. As a result, a toner conveyance failure such that toner is retained by depositing and adhering inside the conveyance case 27 can be prevented more than ever.

Particularly, in the conveyance case 27, toner conveyance can be prompted not only on the downstream side (exit side) of the conveyance case 27 in which toner is easy to be retained but also over the entire area inside the conveyance case 27, whereby toner clogging can be prevented.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-110215, filed May 17, 2011, which is hereby incorporated by reference herein in its entirety.

What is claimed is:

1. A toner conveying apparatus comprising:

a conveying unit providing a toner conveyance path having an inlet portion and an outlet portion and provided for conveying toner from the inlet portion to the outlet portion;

a first rotation member that is rotatable and located upstream in a toner conveying direction of the conveyance path, wherein the first rotation member rotates about a first rotating shaft to convey toner from an outside of the toner conveyance path toward the inlet portion;

a second rotation member that is rotatable and located downstream in the toner conveying direction of the conveyance path, wherein the second rotation member rotates about a second rotating shaft to convey toner from the outlet portion away from the toner conveyance path; and an agitation device that agitates toner in the toner conveyance path, with one end portion of the agitation device connected to a first eccentric shaft eccentric with regard to the first rotation member and another end portion of the agitation device connected to a second eccentric shaft eccentric with regard to the second rotation member.

2. A toner conveying apparatus according to claim 1, wherein the inlet portion is located at a position higher than the outlet portion.

3. A toner conveying apparatus according to claim 1, wherein the agitation device includes a first agitation member whose one end portion is connected to the first eccentric shaft eccentric to the first rotating shaft of the first rotation member; and a second agitation member whose one end portion is connected to the second eccentric shaft eccentric to the second rotating shaft of the second rotation member.

4. A toner conveying apparatus according to claim 3, further comprising a slide member provided between the first agitation member and the second agitation member, wherein the slide member includes a first end portion rotatably attached to another end portion of the first agitation member and a second end portion slidably attached to another end portion of the second agitation member.

5. A toner conveying apparatus according to claim 3, further comprising a slide member provided between the first agitation member and the second agitation member, wherein the slide member includes a first end portion rotatably attached to another end portion of the first agitation member and a second end portion slidably attached to inside a groove portion formed in another end portion of the second agitation member.

6. A toner conveying apparatus according to claim 3, further comprising an extension and contraction member that is extensible and contractible and provided between the first agitation member and the second agitation member, wherein the extension and contraction member includes a first end portion attached to another end portion of the first agitation member and a second end portion attached to another end portion of the second agitation member.

7. A toner conveying apparatus according to claim 1, wherein the agitation device has a first hole portion provided at one end portion thereof and a second hole portion provided at another end portion thereof, wherein the first eccentric shaft is inserted into the first hole portion, and the second eccentric shaft is inserted into the second hole portion.

8. A toner conveying apparatus according to claim 7, wherein the first hole portion has an elongated hole shape and the first eccentric shaft is freely slidable inside the first hole portion; and the second hole portion has an elongated hole shape and the second eccentric shaft is slidable inside the second hole portion.

9. An image forming apparatus comprising:

an image forming section for forming an image by toner;

a conveying unit providing a toner conveyance path having an inlet portion and an outlet portion and provided for conveying toner from the inlet portion to the outlet portion;

a first rotation member that is rotatable and located upstream in a toner conveying direction of the conveyance path, wherein the first rotation member rotates about a first rotating shaft to convey toner from an outside of the toner conveyance path toward the inlet portion;

a second rotation member that is rotatable and located downstream in the toner conveying direction of the conveyance path, wherein the second rotation member rotates about a second rotating shaft to convey toner from the outlet portion away from the toner conveyance bath; and an agitation device that agitates toner in the toner conveyance path, with one end portion of the agitation device connected to a first eccentric shaft eccentric with regard to the first rotation member and another end portion of the agitation device connected to a second eccentric shaft eccentric with regard to the second rotation member.

10. An image forming apparatus according to claim 9, wherein the inlet portion is located at a position higher than the outlet portion.

11. An image forming apparatus according to claim 9, wherein the agitation device includes a first agitation member whose one end portion is connected to the first eccentric shaft eccentric to the first rotating shaft of the first rotation member; and a second agitation member whose one end portion is connected to the second eccentric shaft eccentric to the second rotating shaft of the second rotation member.

12. An image forming apparatus according to claim 11, further comprising a slide member provided between the first agitation member and the second agitation member, wherein the slide member includes a first end portion rotatably attached to another end portion of the first agitation member and a second end portion slidably attached to another end portion of the second agitation member.

13. An image forming apparatus according to claim 11, further comprising a slide member provided between the first agitation member and the second agitation member, wherein the slide member includes a first end portion rotatably attached to another end portion of the first agitation member and a second end portion slidably attached to inside a groove portion formed in another end portion of the second agitation member.

14. An image forming apparatus according to claim 11, further comprising an extension and contraction member that is extensible and contractible and provided between the first agitation member and the second agitation member, wherein the extension and contraction member includes a first end portion attached to another end portion of the first agitation member and a second end portion attached to another end portion of the second agitation member.

15. An image forming apparatus according to claim 9, wherein the agitation device has a first hole portion provided at one end portion thereof and a second hole portion provided at another end portion thereof, wherein the first eccentric shaft is inserted into the first hole portion, and the second eccentric shaft is inserted into the second hole portion.

16. An image forming apparatus according to claim 15, wherein the first hole portion has an elongated hole shape and the first eccentric shaft is freely slidable inside the first hole portion; and the second hole portion has an elongated hole shape and the second eccentric shaft is slidable inside the second hole portion.

17. An image forming apparatus according to claim 9, wherein the image forming section includes:

a transfer belt for transferring a toner image to a transfer material; and a belt cleaning device for collecting toner adhered on the transfer belt, wherein the toner conveyed by the first rotation member toward the inlet portion is the toner collected by the belt cleaning device.

18. An image forming apparatus according to claim 17, further comprising a collection container for collecting toner collected by the belt cleaning device, wherein the second rotation member conveys the toner away from the outlet portion and to the collection container.

19. An image forming apparatus according to claim 17, wherein the first rotation member has a shape of a screw.

20. An image forming apparatus according to claim 18, wherein the second rotation member has a shape of a screw.

* * * * *